United States Patent [19]

Hurley

[11] 4,120,474

[45] Oct. 17, 1978

[54] DRAPERY SUPPORT ASSEMBLY

[75] Inventor: Glen A. Hurley, Dayton, Ohio

[73] Assignee: Hurley's Concepts, Inc., Dayton, Ohio

[21] Appl. No.: 730,017

[22] Filed: Oct. 6, 1976

[51] Int. Cl.[2] ..... A47H 1/10

[52] U.S. Cl. ..... 248/263; 16/93 D; 16/96 D; 248/265

[58] Field of Search ..... 248/263, 265, 267, 270, 248/272, 274, 276, 287; 160/344–347; 16/93 D–96 D

[56] References Cited

U.S. PATENT DOCUMENTS

| | | | |
|---|---|---|---|
| 1,933,719 | 11/1933 | Dilg | 248/265 |
| 1,951,969 | 3/1934 | DiCarlo | 248/265 |
| 2,200,740 | 5/1940 | Gaudet | 211/105.3 |
| 2,557,425 | 6/1951 | Gehret | 160/349 |
| 2,651,489 | 9/1953 | Bell | 248/265 |
| 2,918,245 | 12/1959 | Cameron | 248/263 |
| 2,966,696 | 1/1961 | Young | 16/94 D |
| 2,979,303 | 4/1961 | Freeman | 248/287 |
| 2,998,955 | 9/1961 | Hertzog | 248/263 |
| 3,095,033 | 6/1963 | Polkosnik | 160/345 |
| 3,344,463 | 10/1967 | Znamirowski | 16/94 D |
| 3,430,908 | 3/1969 | Kowalczyk | 248/265 |

*Primary Examiner*—Roy D. Frazier
*Assistant Examiner*—Peter A. Aschenbrenner
*Attorney, Agent, or Firm*—Dybvig & Dybvig

[57] ABSTRACT

A drapery support assembly comprises a bracket adapted to support a drapery rod and slide means to adjustably support the bracket with respect to a wall or the like. The bracket is adapted to support a drapery rod in a first position for supporting a decorative over drapery which would then be the only drapery supported by the bracket. Alternatively, the bracket may mount mechanism in a second position to support a so-called glass curtain or sheer and is adapted to then mount a second bracket or extension means for then supporting the decorative cover drapery adjacent the glass curtain or sheer. Further disclosed in the present application are means to strengthen or rigidify drapery mounting members, adjust the same and, in modifications, diverse drapery mounting components.

17 Claims, 11 Drawing Figures

DRAPERY SUPPORT ASSEMBLY

BACKGROUND OF THE INVENTION

1. Field of the Invention

This invention relates to drapery mounting assemblies and more particularly to vertically adjustable assemblies suitable for mounting both a drapery and a sheer or glass curtain and suitable for conversion from an assembly for mounting only a drapery to an assembly for mounting both a drapery and a sheer.

2. Prior Art

Devices for optionally mounting only a drapery, or a drapery in combination with a sheer, are known in the art. As will be more particularly described in the present application, such devices are known to support the rods or rodding which enable the drapery or draperies to be traversed from side to side. A limitation to all such devices known to the applicant is that the transition from a single drapery mounting to a combined drapery and sheer mounting requires a substantial reassembly of the original drapery support to effect a conversion for the support of a drapery along with a sheer. A further difficulty with drapery support mechanism of the prior art is that they are designed for fixed attachment to the wall surrounding the window over which the drapery or draperies will hang. As a consequence, the original hanging frequently requires adjustment under exceedingly difficult conditions to correct for initial hanging errors, drapery stretching, drapery shrinkage or the like. Curtain mounting brackets have been designed to permit vertical adjustments of curtain rods. The known vertically adjustable brackets, however, are not usable for mounting draperies.

SUMMARY OF THE PRESENT INVENTION

In the present invention, the hanging of draperies and the like is accomplished by a mounting assembly including a frame member or slide fixedly attachable to a supporting wall and having means for adjustably supporting the drapery mounting assembly, the adjustable support means anticipating vertical adjustments as may from time to time be required as the draperies may stretch or shrink in length. The present invention also provides an initial drapery mounting arm for mounting only a single drapery without an accompanying sheer and provides an extension arm readily attachable to the original mounting arm which converts the original mounting to one for supporting both the original drapery and a sheer, such modification being accomplished by mounting the extension arm on the original mounting arm and by means of interfitting connections between the original mounting arm and the extension arm.

It is accordingly an object of the present invention to provide a drapery mounting assembly which is convertible in a simple fashion from an assembly for mounting a single drapery to an assembly for mounting a drapery in combination with a sheer.

It is another object of the present invention to provide a drapery mounting assembly having a simplified means for vertical adjustment of the assembly.

Still another object of the present invention is to provide a drapery mounting assembly of an improved and rigidified construction.

Other objects and advantages will become apparent from the following description and the drawings.

DESCRIPTION OF THE PREFERRED EMBODIMENTS

Figure 1:
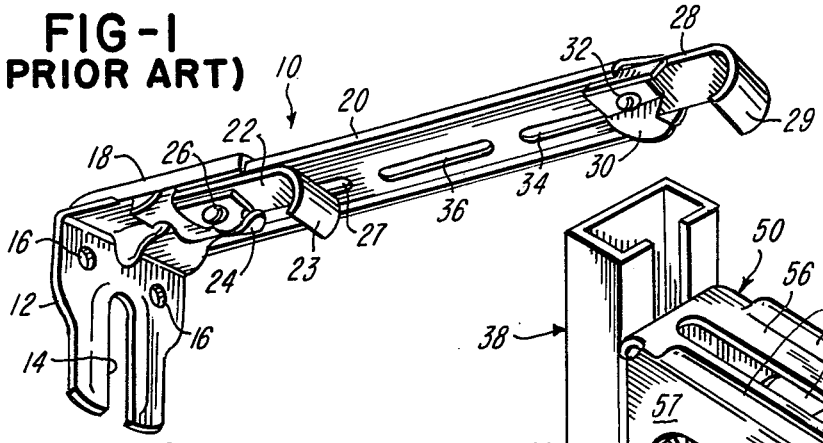
FIG-1 (PRIOR ART)
FIG. 1 is a perspective view illustrating a drapery mounting assembly known in the prior art.

To emphasize the novel features embodied in the drapery mounting assembly of the present invention, an example of a prior art mounting assembly 10 is illustrated in FIG. 1. Such mounting assembly includes a support bracket 12 having apertures or screw holes 16 for the receipt of fasteners (not shown) by which the mounting assembly 10 may be fixedly attached to a wall or the like. The bracket 12 has a slot 14 which may be initially supported for vertical sliding movement on a temporary supporting bolt (not shown), the final vertical position being anchored by screws (not shown) passing through the apertures 16.

The mounting assembly 10 includes an outwardly projecting arm 18 which extends vertically outwardly from the wall to which the mounting bracket is attached. The arm 18 has an aperture, not illustrated, through which a threaded fastener 26 passes. The fastener 26 normally extends parallel to the wall to which the bracket 12 is attached. The fastener 26 mounts to the bracket 12 an assembly of three elements comprising an extension arm 20 facially contacting the arm 18, an elongate rod support 22 and a rod hook 24 which is rotatably positioned about the axis of the fastener 26 so as to confront an arcuate flange 23 integral with the rod support 22. The hook 24 and flange 23 define therebetween a channel for the receipt of a conventional drapery rodding (not shown) which would pass under the extension arm 20 in a direction generally parallel to the plane of the wall to which the assembly 10 is attached. Such drapery rodding, when engaged between the hook 24 and the flange portion 23, can be referred to as the outboard drapery rod because outermost from the center of the room in which the drapery is being located.

The inboard end of the extension arm 20 contains an elongate aperture or slot 34 for receiving a second fastener 32. The fastener 32 mounts a second rod support 28 and a second hook member 30 adapted to cooperate with an arcuate flange 29 on the rod support 28 to channel an inboard rod (not shown). As is evident, the spacing between the inboard and outboard rods which are to be supported by the drapery support assembly of FIG. 1 is rendered adjustable by means of the aforementioned elongate slot 34 and a companion aperture or slot 27, the latter enabling adjustment as to the outboard position of the extension arm 20 and the former enabling adjustment of the outboard position of the support 28 along the length of the extension arm 20. An elongated intermediate slot 36 disposed between the slots 27 and 34 is provided for attachment of a supporting truss (not shown), should one be desired.

Although prior art devices of the type illustrated and described with reference to FIG. 1 have been commercially available devices, experience with such devices has indicated three significant drawbacks. The initial height of the mounting bracket 12 is determined by the screws which enter the screw holes 16. For many reasons, it is easy to mount the bracket at an improper height. Adjustments or corrections to the initial height, while rendered available by the vertically extending slot 14, are not easily accomplished because this means removal of the screws initially entering the screw holes 16 and the creation of new wall apertures to receive the screws which will secure the mounting bracket 12 after adjustment. Unless any adjustment to be made is large in relation to the diameter of the screws initially used to secure the mounting bracket 12 to the wall, there may be an overlap between the screw holes originally placed in the wall to receive the mounting screws and the new set of screw holes which will be needed to effect adjustment. Those skilled in the art will immediately appreciate the difficulties involved in effecting small adjustments in the vertical height of the mounting bracket 12. Those skilled in the art will further appreciate that, due to the difficulties in effecting adjustments, the drapery installer first mounts the bracket 12 by a temporary fastener inserted in the slot 14 and accomplishes a final adjustment by screws entering the screw holes 16. The main problems thus occur after drapery installation and after stretching or shrinkage has occurred. This problem is a primary cause of dissatisfaction with drapery installations, and cure of the problem is normally quite expensive and time consuming.

Homeowners frequently desire only the inboard, i.e., interior decorative, draperies on initial installation; and this is most conveniently accomplished by omitting the extension arm 20 along with the inboard rod support assembly. This means that the fastener 26 is initially attached directly to the arm 18 and the extension arm 20 not used. Later when the homeowner has elected to employ a sheer also, this means a complete disassembly of the original installation except for the mounting brackets 12, a reassembly of the installation to include the extension arms 20, and the hazard that the newly assembled inboard and outboard drapery mountings will be fractionally too high or too low so that an adjustment in the vertical height of the mounting bracket 12 will become necessary.

A third drawback to the prior art structure is that the rod support assemblies which support the inboard and outboard drapery rodding, while useful with various types of rodding, require modification or disassembly to change from one type of rodding to another type or rodding. Because of the labor involved in effecting a change, it is a common practice when changing rod types to completely replace the mounted brackets with new brackets.

Figure 2:
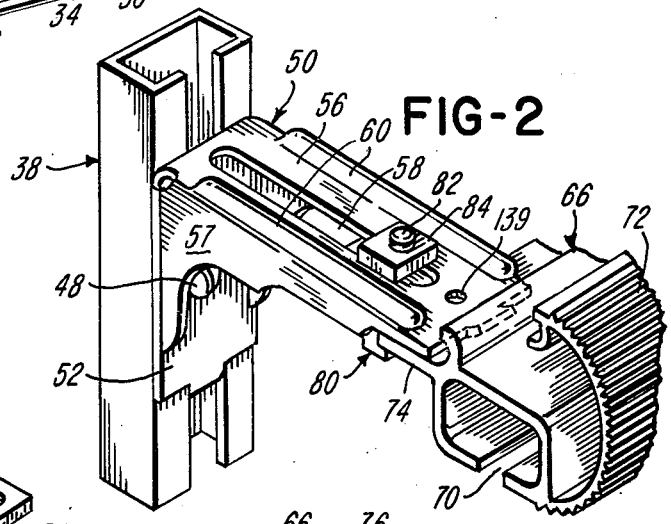
FIG. 2 is a perspective view illustrating one embodiment of a drapery mounting assembly in accordance with the present invention.
Figure 3:
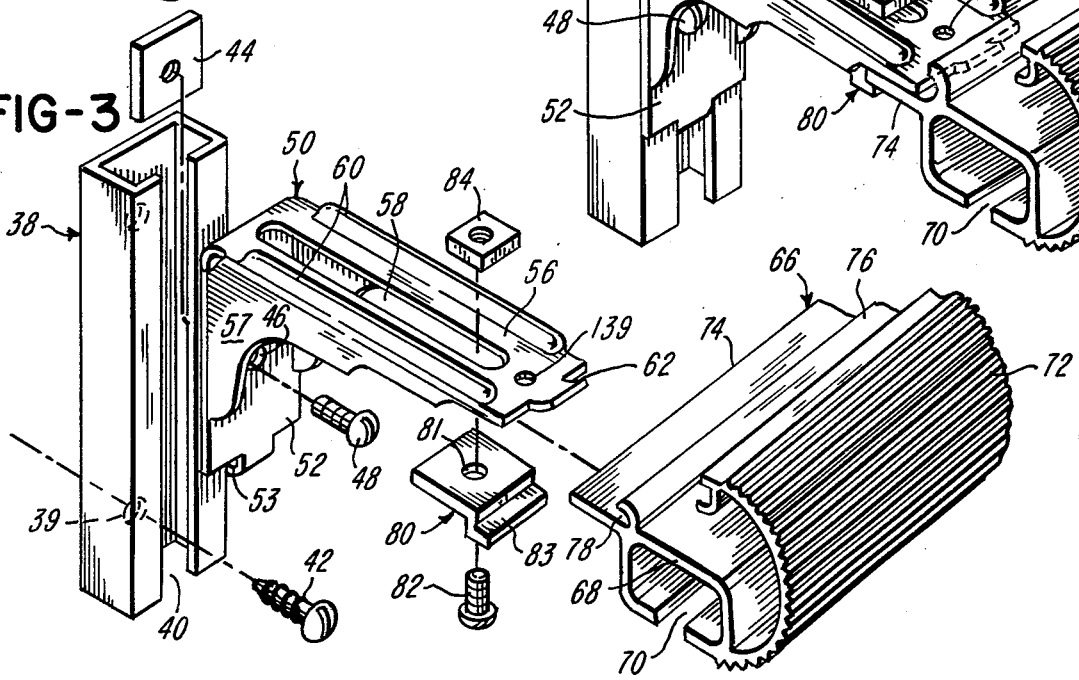
FIG. 3 is an exploded illustration of the embodiment of FIG. 2.
Figure 4:
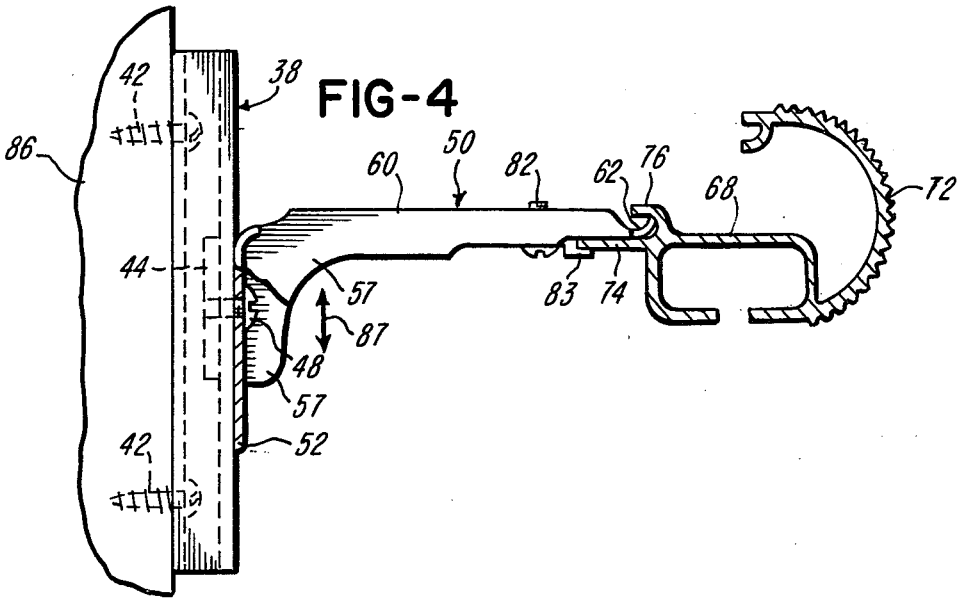
FIG. 4 is a side elevation view with a portion broken away illustrating the drapery mounting assembly of FIG. 2 attached to a wall.

FIGS. 2, 3 and 4 illustrate a drapery mounting assembly in accordance with the present invention. The assembly is of a type suitable for mounting a single drapery, sometimes known as a cover drapery or a decorative drapery. The assembly also offers the benefit that, at any time after initial installation, the single decorative or cover drapery may be moved to a new position which accommodates a sheer drapery or glass curtain between the decorative drapery and the window which is to be covered by the drapery assembly. FIGS. 2, 3 and 4 illustrate such an assembly before modification to accommodate the sheer or glass curtain.

The mounting assembly comprises a frame member or slide 38, which is preferably a hollow, generally rectangular extruded member such as a formed design of steel or aluminum. The member 38 has a slot 40 extending longitudinally along one major face thereof, and the opposite major face of the member 38 has apertures 39 therein which are adapted to receive threaded fasteners or screws 42 (only one of which has been illustrated in FIG. 3), which are used to secure the frame member 38 to the wall against which a drapery is to be hung. The fasteners 42 are intended to effect a permanent mounting for the frame member 38; and, in accordance with the present invention, no need will exist to adjust the elevation at which the frame member 38 is fixedly attached to a wall.

Adjustably mounted to the frame member 38 is a mounting bracket 50 having a depending leg 52 through which passes an aperture 46 for receipt of a threaded fastener 48. The fastener 48 threadedly engages a threaded aperture located in a rectangular nut 44, which is sized to enter the frame member 38 and to be slidable within the frame member 38 along the length of the slot 40. To prevent twisting of the bracket 50 about the axis of the fastener 48, the leg 52 has one or more parts projecting into the slot 40 for sliding movement therealong. Such a projecting part may comprise the illustrated tongue 53. When the bracket 50 has been located along the length of the frame member 38 to approximately the elevation desired for drapery mounting, as will be described, the fastener 48 is tightened with respect to the nut 44 to secure the bracket 50 against further sliding movement with respect to the frame member 38.

The bracket 50 includes an arm 56 supported at right angles to the leg 52 by means of side braces 57 which may be molded as one piece with the leg 52 and the arm 56 or which may be part of a sheet metal blank which has been cut to an appropriate shape and formed with the braces 57 bent downwardly as they appear in FIG. 3 to bear against the leg 52. The arm 56 is also rigidified by means of elongated ribs 60 pressed upwardly as shown in FIG. 3 adjacent the side margins of the arm 56, such ribs cooperating with the braces 57 to resist a downward bending of the arm 56 under the weight of draperies and drapery rods which will be supported by the arm 56.

The arm 56 also includes a longitudinally extending slot 58 located centrally in the arm 56 between the ribs 60. Projecting from the end of the arm 56 outermost from the leg 52 is an upwardly turned hook portion 62.

The reference number 66 depicts a form of drapery rod or rodding known in the art as decorative extruded rodding. This rodding, which is preferably an extrusion of aluminum or other metal, includes a centrally disposed channel portion 68 having a slot 70 extending longitudinally along the underside thereof. As known to those skilled in the art, the slot 70 is designed to receive conventional drapery gliders or hangers (not shown) which are slidable within the channel 68 and which are adapted to support a drapery (not shown) which hangs below the rodding 66.

Arching upwardly from the lower side of the channel 68 is a curved shield 72, which may be serrated as shown and which serves primarily a decorative purpose. Considering the expression "inboard" as referring to the interior of the room in which the draperies will be hung, the serrated shield 72 is disposed to the inboard side of the channel 68. Disposed to the outboard side of the channel 68 is a flange 74 which is generally coplanar with the upper surface of the channel 68. Arching upwardly and in the inboard direction from the junction between the flange 74 and the channel 68 is a longitudinally extending wall 76 which cooperates with the flange 74 to form a longitudinally extending channel 78 which faces to open in the outboard direction.

The hook portion 62 which is located at the inboard end of the bracket arm 56 is designed to interfit the channel 78. In the ordinary mounting of draperies so as to cover a single window, there will be two frame members 38, one disposed to each side of the window, and two brackets 50, each terminating at the inboard end thereof with a hook portion 62, interfitting the channel 78 of the rodding 66. Three or more assemblies of frame members 38 and brackets 50 may be used for supporting heavy drapes or drapes spanning a substantial distance.

The decorative rodding 66 is fixedly attached to the mounting brackets 50 by means of suitable fasteners, such as the Z clip or washer 80 illustrated in FIG. 3, which has an aperture 81 adapted to receive a threaded bolt 82 which passes upwardly through the slot 58 in the bracket 50 to enter a threaded nut 84. The nut 84, which may be a square-shaped nut, is sized to fit relatively closely between the strengthening ribs 60 in the bracket arm 56 so that the nut 84 will not turn about its own axis as the fastener 82 is tightened with an appropriate torque.

The Z clip 80 can be seen to have a ledge 83 which is offset to receive the flange 74 of the decorative rodding with a snug fit. Accordingly, as the threaded fastener 82 is torqued into the nut 84 after the hook portion 62 of the bracket 50 has been seated in the channel 78 of the decorative rodding, the flange 74 is seized with a friction grip to prevent an inadvertent removal of the decorative rodding from the brackets 50 which support the same. As an alternative to the Z clip or washer, a conventional round washer may be satisfactorily used with the bolt 82. It will be noted that the primary support for the decorative rodding and the drapery or draperies that will hang therefrom resides in the wall 76 which will bear against the bracket hook portion 62 and in the flange 74 which, by bearing upwardly against the bracket arm 56, resists the tendency of the decorative rodding to swing downwardly from the bracket arms 56.

FIG. 4 illustrates a completed drapery mounting assembled to a wall 86. As previously indicated, there will be at least two such mountings to support a single assembly of draperies spanning a window opening and an indefinitely long length of rodding 66 will extend between the two mountings. Assuming draperies which are not shown in FIG. 4 have been mounted by appropriate hangers or gliders for sliding movement along the channel 68, any needed height adjustment is readily accomplished by loosening the threaded fasteners 48 to permit the square nut 44 along with its associated support bracket 50 to be adjusted vertically to whatever level is desired. FIG. 4 thus illustrates by means of an arrow 87 the possibility of vertical adjustment of the support brackets 50.

Figures 5, 6, 7, 8, 9, 10, 11:
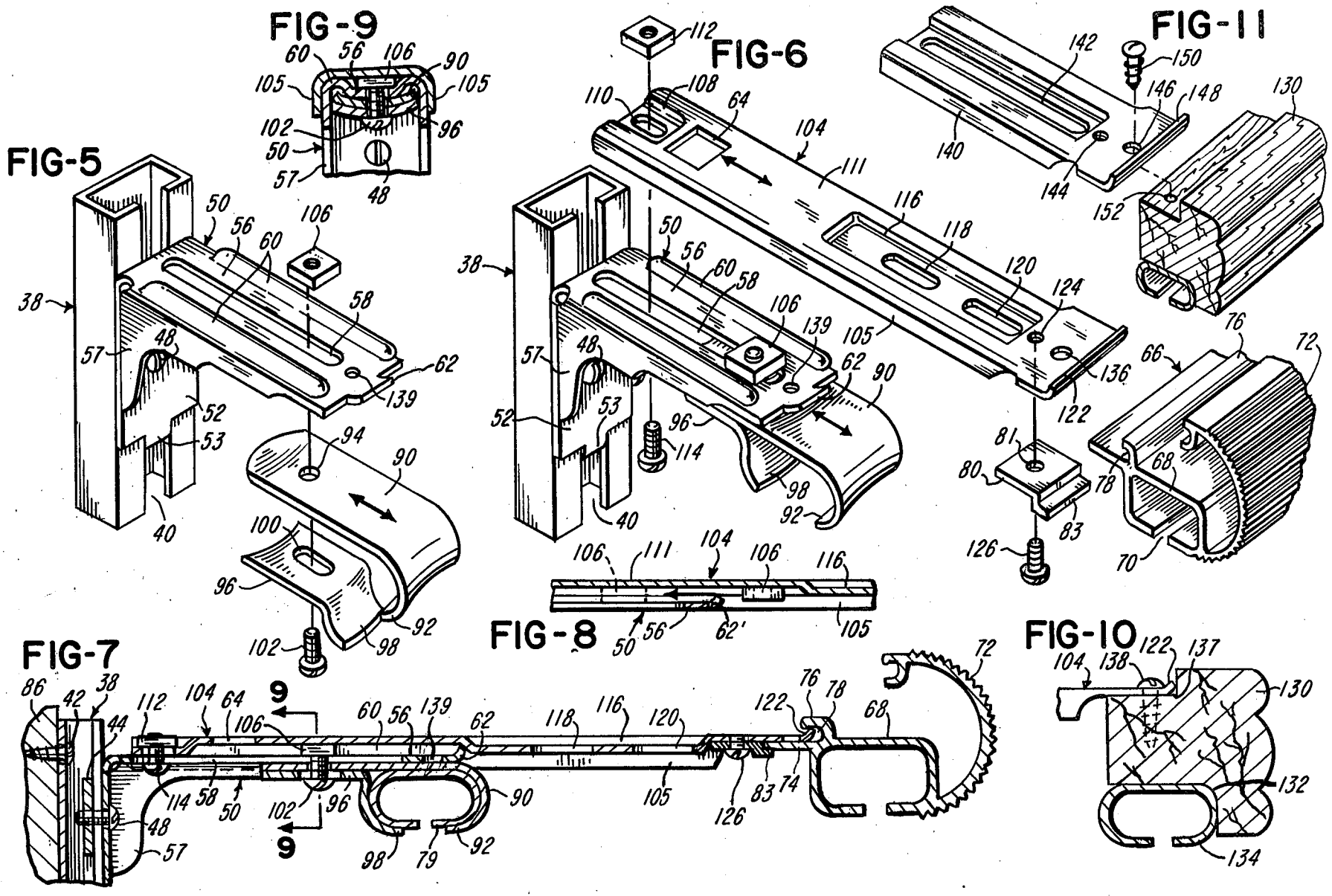
FIG. 5 is an exploded perspective illustration of the drapery mounting illustrated in FIG. 2 with a different type of rodding.
FIG. 6 is an exploded perspective view illustrating a second modification of the drapery mounting illustrated in FIG. 5 with an extension member for mounting a second rodding and illustrating the manner in which one type of rodding can be assembled on the extension member.
FIG. 7 is a fragmentary section view illustrating the structure of FIG. 6 after affixation to a wall.
FIG. 8 is a fragmentary section view illustrating another embodiment of the apparatus illustrated in FIG. 6.
FIG. 9 is a fragmentary section view taken substantially along the line 9—9 of FIG. 7.
FIG. 10 is a fragmentary section view illustrating the manner in which another type of rodding can be mounted in accordance with the present invention.
FIG. 11 is an exploded perspective view illustrating a modified form of extension member.

FIG. 5 illustrates the manner in which the bracket 50 is adapted to support standard drapery rodding as opposed to the decorative rodding illustrated in FIGS. 2, 3 and 4. A first rodding support 90 having an arcuate flange 92 is assembled along with a second rodding support 96 having a hook portion 98 to the previously described bracket 50. The assembly is accomplished by means of a fastener 102 entering an elongated aperture 100 in the support 96 and an aperture 94 in the rodding support 90, said fastener passing through the slot 58 in the bracket 50 to threadedly engage a square nut 106 which is restrained against rotation by the previously described ribs 60 located in the outwardly projecting arm 56 of the bracket 50.

As appears in FIGS. 5 and 9, the supports 90 and 96 are transversely curved so as to nest together between the side braces 57 of the bracket 50 and resist twisting about the axis of the fastener 102. These supports are typical of various prior art supports for use in mounting conventional metal drapery rods. Other similar devices could be fastened to the arm 56 in the same way and for the same purpose.

The elongated aperture 100 located in the rodding support 96 allows the support 96 to be moved laterally with respect to the support 90 to firmly engage rodding (not shown) which passes between the flange 92 of the support 90 and the hook portion 98 of the support 96. The slot 58 located in the bracket 50 allows the rodding and its supports 90 and 96 to be advanced longitudinally along the bracket arm 56 to a preferred drapery support position, such adjustment being desirable to appropriately space the drapery being supported with respect to window sills and the like. It will be noted that this type of adjustment is not available in the previously described mounting for the decorative rodding 66 because the decorative rodding is abutted against the hook portion 62 of the bracket 50.

Those skilled in the art will understand that the drapery mounting above described with reference to FIG. 5 is suitable only for the mounting of an outboard drapery, which may be either a decorative drapery or a sheer drapery. The mounting is, however, readily adaptable for the support of an inboard drapery alongside the outboard drapery by means of an optional extension member described below.

In FIG. 6, the outboard drapery mounting of FIG. 5 is retained intact, and extension arm 104 is laid over the bracket 50 upon which conventional outboard rodding 79 may be assembled. The extension arm 104 is equipped with longitudinal side flanges 105 adapted to straddle the side braces 57 for the outwardly extending arm 56 of the bracket 50.

The extension arm 104 can be seen to have a generally rectangular or square-shaped recess 108 press formed in a face 111 thereof. Disposed within the recess 108 is an elongated aperture 110 for the receipt of a fastener 114 threaded into a generally square nut 112. The nut 112 is sized to fit within the recess 108 and to be nonrotatably retained by the side walls of the recess 108.

The extension arm 104 has a second recess 116 spaced from the recess 108 toward the opposite end of the arm 104, the second recess 116 being rectangular in shape and being substantially longer than the generally square recess 108. The recess 116 has two elongated apertures 118 and 120 disposed therein, such apertures being elongated in the direction of the length of the extension arm 104. The more central aperture 118, while not required for the drapery mountings described in the present application, is conveniently made available as a part of the mounting hardware herein disclosed for the attachment of trusses or the like which may be used to reinforce the drapery mounting against the type of loading that would occur should the drapery be exceptionally heavy or should the window widths to be spanned by the draperies being mounted be exceptionally long, with the result that the draperies and/or glass curtains may present a substantial load to be supported by the extension arms 104.

As illustrated in FIG. 6, the extension arm 104 is adapted to mount the decorative rodding by means of an upwardly turned hook portion 122 which is adapted to fit into the previously described channel 78 formed in the decorative rodding described in reference to FIGS. 2 through 4. To this end, the extension arm 104 has therein a threaded aperture 124 adapted to threadedly engage a fastener 126 used to secure a Z clip or washer 80 of the type previously described, or a conventional round washer (not shown). Upon seating of the hook portion 122 of the extension arm 104 into the channel 78 of the decorative rodding, the threaded fastener 126 is tightened to pull the Z clip 80 firmly upwardly against the underside of the extension arm 104 to mount the rodding 66.

The homeowner sometimes desires to commence his interior decoration with only a decorative type of drapery mounted to a decorative type of rodding, such as illustrated in FIG. 6, preferring to defer until a later date the mounting of a sheer to rodding supported by the supports 90 and 96 illustrated in FIGS. 5 and 6. In such case, the elements 90 and 96 and their associated fastener hardware may be omitted from the original drapery assembly. When the homeowner later requests a sheer drapery mounting, it is then desired to insert the supports 90 and 96, for the purposes of mounting a sheer drape, with a minimum of disturbance to the original decorative drapery mounting. This objective is readily accomplished as will now be described. An aperture 64 sized to permit the passage therethrough of a nut such as the nut 106 illustrated in FIG. 6 is formed in extension arm 104 intermediate the recesses 108 and 116. In cases where the initial drapery installation did not call for an outboard drapery support such as provided by the support members 90 and 96 of FIGS. 5 and 6, one need merely insert the nut 106 through the aperture 64 to locate the nut 106 between the bracket arm 56 and the extension arm 104 at a position overlying the slot 58 which is present in the mounting bracket 50.

A variation in the method of inserting the nut 106 between the bracket arm 56 and the extension arm 104 is illustrated in FIG. 8. Here, the hooked portion 62 is divided into two laterally spaced hook portions 62', only one of which can be seen in FIG. 8. The hook portions 62' are spaced apart sufficiently that one can slide the nut 106 under the extension arm 104 and through the spacing between the hook portions 62'. The manner in which such insertion of the nut 106 is accomplished is schematically illustrated in FIG. 8, which shows the nut 106 about to be inserted between the hook portions 62' under the face 111 of the extension arm 104 and over the arm 56 of the bracket 50.

When such insertion of the nut 106 has been accomplished, it is then possible to mount the supports 90 and 96 with a fastener such as the fastener 102 illustrated in FIG. 5, which threadedly engages the newly installed nut 106. The desired outboard position for a sheer drapery is then fixed by sliding the supports 90 and 96 along with the fastener 102 and the nut 106 along the length of the slot 58 located in the mounting bracket 50 to whatever outboard position may be desired and then tightening the fastener 102. FIG. 7 illustrates a completed drapery mounting having both inboard and outboard drapery supporting positions, the inboard position being occupied by the decorative rodding and the outboard position being occupied by conventional drapery rodding. In lieu of decorative extruded rodding, conventional drapery rodding may be connected to the inboard position by mounting supports, such as the supports 90 and 96 illustrated in FIG. 5, to the inboard end of extension arm 104, utilizing the previously described aperture 120 which is located in the extension arm 104.

It will be noted that the extension arm 104 is in the shape of an inverted channel and that the portion thereof between its recesses 108 and 116 is not recessed. Further, since it is supported by the ribs 60, as best shown in FIGS. 7 and 9, the extension arm 104 can slide along the bracket arm 56 to the extent permitted by the length of the bracket arm slot 58 that can be occupied by the bolt 114. Thus, by loosening the bolt 114, the relative positions of the extension arm 104 and the bracket arm 56 can be varied to adjust the spacing of the rodding supported by the extension arm 104 from the wall. After the desired spacing is obtained, the bolt 114 can be tightened to maintain the adjusted position of the arm 104. This adjustment can be carried out without disturbing the position of the conventional rodding 79 shown in FIG. 7. It is also possible to adjust the position of the conventional rodding 79 shown in FIG. 7 by loosening the bolt 102 and sliding it along the slot 58 without disturbing the position of the extension arm 104. The capability of a wide range of independent adjustment of the rodding mounted directly on the bracket arm 56 and the rodding mounted on the extension arm 104 is an important feature of the present invention. Use of the drapery mounting assembly shown in FIGS. 6, 7 and 9 should save many tedious hours now taken to achieve adjustments using conventional mounting hardware.

A further type of drapery mounting that has become popular involves the use of wood trim, such as the trim 130 illustrated in FIG. 10. This trim has a first notch or groove 132 at a lower corner adapted to receive conventional rodding 134. The trim 130 also has a second notch or groove 137 at an upper corner thereof which is sized to receive the hook portion 122 of the extension arm 104. The wooden trim 130 is thus easily attached to the extension arm 104 by means of a threaded wood screw 138 passed through a non-threaded aperture 136 located in the extension arm 104 adjacent the hook portion 122. The bracket arm 56 may also have a non-threaded aperture 139 adjacent its outer end for the mounting of the wood trim 130 thereto in the same manner the wood trim is mounted on the extension arm 104. Thus, both the bracket arm 56 and the extension arm 104 are designed to be used for the mounting of various types of rodding, including the conventional rodding 79, the decorative extruded rodding 66, and the wood trim rodding 130.

As those familiar with the mounting of draperies will be aware, the bracket 50 and the extension arm 104 can be used in the majority of drapery installations. For example, frame or slide 38 and the bracket 50 can be built to support conventional rodding such as rodding 79, at separations from the wall of approximately 2 to 3½ inches, this separation being adjustable because of the nut and bolt mounting of the supports 90 and 96 along the bracket arm slot 58. (The same type of adjustment is available in prior brackets, such as that shown in FIG. 1.) The same bracket 50 can be used to support the decorative extruded rodding 66 at about 3½ inches from the wall and the wood trim 130 slightly closer to the wall on the order of 3½ inches. Spacing on the order of 3 to 3½ inches is typical for single decorative draperies and sheers. When using the extension arm 104, the inboard rodding, that is, the rodding farthest from the wall, of the conventional type designated 79 herein can be mounted between 5½ to 8¾ inches, the decorative rodding 66 approximately 7 to 8¾ inches and the wood trim 130 approximately 6½ to 8¼ inches from the wall. This is based upon the use of an extension rod which is approximately 6 inches long. These ranges are all adequate for the inboard mounting of decorative draperies either with or without sheers or glass curtains.

Occasionally a drapery installer is faced with the problem of mounting a drapery close to the wall, i.e., as far outboard from the center of the room as possible, but beyond a wide window sill, baseboard heating element, or the like. In such event, it is possible that neither the bracket 50 alone nor the bracket 50 with the addition of the extension arm 104 can be used to span the desired distance. Therefore, this invention further contemplates a short extension arm 140 illustrated in FIG. 11. Short extension arm 140 is generally in the shape of an inverted channel and has a recessed portion surrounding a longitudinally extending slot 142 and thus is adapted to be mounted over the bracket arm 56 with a bolt and nut (not shown) identically to the manner in which the extension arm 104 is mounted by the bolt 114 and nut 112. The outer end of the short extension arm 140 has a tapped hole 144 and a punched hole 146 and a turned-up hook portion 148 for mounting the various types of rodding, these parts performing the same function as the tapped hole 124, the punched hole 136, and the hooked portion 122 at the end of the longer extension arm 104. FIG. 11 also illustrates the manner in which the punched hole 146 is adapted to receive a screw 150 for attachment to a wood trim rodding member 130 which may for this purpose have a screw-receiving hole 152.

The short extension arm 140 can be mounted upon the bracket arm 56 so that the outer end parts thereof are in vertical alignment. Thus, for example, the punched hole 146 can be aligned with the punched hole 139 of the bracket arm 56. Accordingly, when using the short extension arm 140, it would be possible to locate the rodding mounting thereon as close to the wall as it would be when no extension arm is used. Of course, it is intended that the short extension arm would normally be extended beyond the free end of the bracket arm 56 so as to extend the possible position of rodding up to approximately 5 inches from the wall. To achieve this added degree of flexibility in the position of the rodding, the short extension arm 140 can be about 2⅝ inches long and its longitudinal slot 142 about 1 5/16 inches long.

The frame member or slide 38 preferably is sufficiently long to permit a vertical adjustment of the bracket 50 on the order of 2 to 3 inches. A knowledgeable installer will usually be aware of the stretch or shrink characteristics of the type of fabric being mounted and will thus tend to mount the frame member or slide 38 and the bracket 50 to allow for maximum stretch or shrinkage so that, after the draperies have been used or cleaned and the effects of stretching or shrinking taken place, the brackets 50 can be vertically moved as necessary to reposition the draperies.

From the foregoing description, it is seen that this invention provides a universal type of drapery mounting with the wall-mounted frame member or slide 38 to which the bracket 50 is connected, the parts being vertically adjustable yet sufficiently strong when assembled to support both decorative draperies and sheers or the like. Using the larger extension arm 104, decorative draperies and sheers can be mounted simultaneously or separately, and the rodding for both can be horizontally adjusted relative to one another and to the wall, the adjustment for one not affecting the adjustment of the other.

Although the preferred embodiments of the present invention have been described, various changes may be made within the scope of the appended claims.

Having thus described my invention, I claim:

1. An adjustable drapery support assembly comprising in combination a vertically extending frame member, means for securing one side of said frame member against a wall, an opposite side of said frame member bounding a longitudinal slot, a mounting bracket having a bracket leg adapted to lie facially against and slidably engage said opposite side and a bracket arm projecting outwardly from said opposite side at substantially a right angle to said leg and adapted for supporting drapery rodding, said arm having depending side walls bearing against said leg, rib means extending along sides thereof and projecting outwardly therefrom for resisting bending movements of said arm, and a longitudinally extending slot disposed between said rib means, the end of said arm remote from said leg being deflected outwardly to form a hook portion, a nut bearing against said opposite side and slidable longitudinally of said frame member, a fastener passing through an aperture in said leg between said side walls and engaging said nut through the slot bounded by said opposite side for fixedly securing said leg in facially contacting relation to said opposite side, and an extension arm overlying said bracket arm, fastener means passing through said slot of said bracket arm for securing an end of said extension arm disposed adjacent said frame member to said bracket arm, said extension arm overlying said hook portion.

2. A drapery support assembly according to claim 1 wherein said leg has a tongue projecting therefrom into said slot and cooperating with said fastener and said nut to restrain said mounting bracket against rotation about the axis of said fastener.

3. An adjustable drapery support assembly comprising in combination a vertically extending frame member, means for securing one side of said frame member against a wall, an opposite side of said frame member bounding a longitudinal slot, a mounting bracket having a bracket leg adapted to lie facially against and slidably engage said opposite side and a bracket arm projecting outwardly from said opposite side at substantially a right angle to said leg and adapted for supporting drapery rodding, a nut bearing against said opposite side and slidable longitudinally of said frame member, a fastener passing through an aperture in said leg and engaging said nut through the slot bounded by said opposite side for fixedly securing said leg in facially contacting relation to said opposite side, said arm having rib means extending along sides thereof and projecting outwardly therefrom for resisting bending movements of said arm and a longitudinally extending slot disposed between said rib means, the end of said arm remote from said leg being deflected outwardly to form a hook portion, an extension arm overlying said bracket arm, and fastener means passing through said slot of said bracket arm for securing an end of said extension arm disposed adjacent said frame member to said bracket arm, said extension arm overlying said hook portion, the assembled said bracket arm and said extension arm being constructed to provide an opening for admitting a nut between said extension arm and said rib means of said bracket arm.

4. The drapery support assembly of claim 3 including a rodding support and a cooperating hook portion and further including fastener means engaging said rodding support and said hook portion and threadedly engaged to said nut, said fastener means passing through the slot of said arm.

5. The drapery support assembly of claim 4 wherein said rodding support and said hook portion have curved portions held in nesting relationship by said fastener means.

6. The drapery support assembly of claim 5 wherein said extension arm terminates remotely from said frame member with a hook portion, said extension arm having an aperture adjacent said hook portion for the receipt of fastener means for attaching drapery rodding to said extension arm.

7. The drapery support assembly of claim 6 wherein said fastener means comprises a wood screw and said rodding is mounted to wooden trim engaged by said wood screw.

8. An adjustable drapery support assembly comprising a bracket having a leg and a bracket arm projecting at substantially a right angle to said leg, means for mounting said leg on a wall, said bracket arm having an elongate slot for mounting drapery rodding supports on the underside of said bracket arm at adjusted positions relative to the wall by fastener means projecting through said supports and said slot, an extension arm configured to support various types of drapery rodding, and means for connecting said extension arm in overlying relation to said bracket arm, the overlapping portions of said bracket arm and said extension arm being configured to provide a space for receiving part of said fastener means, so that said fastener means may be assembled on or moved relative to said bracket arm subsequent to assembly of said extension arm on said bracket arm without changing the position of said extension arm.

9. The assembly of claim 8 wherein said part of said fastener means comprises a nut and said bracket arm is provided with rib means extending along both sides of said elongate slot nonrotatably confining said nut.

10. The assembly of claim 9 wherein said extension arm has an aperture for admitting said nut into said space.

11. The assembly of claim 8 wherein said means for mounting said leg on a wall comprises a frame member adapted to be mounted on a wall and fastener means connecting said leg to said frame member, one of said leg and said frame member having an elongate vertical slot through which said fastener means extends so that the position of said bracket may be vertically adjusted.

12. The assembly of claim 8 wherein said bracket arm has depending side walls bearing against said leg and straddling portions of said supports and thereby restraining rotation of said supports relative to said bracket.

13. The assembly of claim 12 wherein said extension arm has longitudinal side flanges adapted to straddle said side walls.

14. The assembly of claim 8 wherein said extension arm has an elongate slot adjacent its end remote from said leg for mounting drapery rodding supports on the underside of said extension arm at adjusted positions relative to the wall by fastener means projecting through said last mentioned supports and said last mentioned elongate slot.

15. The assembly of claim 14 wherein both said bracket arm and said extension arm have adjacent their respective ends remote from said leg at least one hole and a hook portion for the mounting of different types of drapery rodding on said ends thereof.

16. An adjustable drapery support assembly comprising a bracket having a leg and a bracket arm projecting at substantially a right angle to said leg, said arm being configured to support various types of drapery rodding, means for mounting said leg on a wall, an extension arm configured to overlie said bracket arm and to support various types of drapery rodding, means for connecting said extension said extension arm in overlying relation to said bracket arm, drapery rodding support members, and means for connecting said support members underneath said bracket arm further from said leg than the end of said extension arm closest to said leg.

17. The assembly of claim 16 wherein said bracket arm has an elongate slot, said extension arm being connected to said bracket arm by first fastener means extending through said slot and said support members being connected to said bracket arm by second fastener means extending through said slot at a position more remote from said leg than said first fastener means.

* * * * *

UNITED STATES PATENT AND TRADEMARK OFFICE

CERTIFICATE OF CORRECTION

PATENT NO. : 4,120,474

DATED : October 17, 1978

INVENTOR(S) : Glen A. Hurley

It is certified that error appears in the above-identified patent and that said Letters Patent are hereby corrected as shown below:

Col. 4, line 3, "or" should be ---of---.

Col. 9, line 21, "3 1/2" should be ---3 1/8---.

Col. 12, line 47, first occurence, "said extension" should be omitted.

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*